US006138723A

United States Patent [19]

Wagner

[11] Patent Number: 6,138,723

[45] Date of Patent: Oct. 31, 2000

[54] FILLING ARRANGEMENT

[75] Inventor: Georg Wagner, Graz, Austria

[73] Assignee: Binder & Co. AG, Gleisdorf, Austria

[21] Appl. No.: 09/474,144

[22] Filed: Dec. 29, 1999

[30] Foreign Application Priority Data

Jan. 8, 1999 [AT] Austria ..... 12/99 U

[51] Int. Cl.[7] ..... B65B 1/04

[52] U.S. Cl. ..... 141/313; 141/114; 141/316; 141/317; 141/312; 53/573; 53/570; 53/468

[58] Field of Search ..... 141/10, 114, 312, 141/313, 314, 315, 316, 317, 392; 53/573, 571, 570, 567, 459, 468, 469

[56] References Cited

U.S. PATENT DOCUMENTS

| | | | |
|---|---|---|---|
| 3,746,057 | 7/1973 | Titchenal | 141/114 |
| 3,750,721 | 8/1973 | Hudson | 141/114 |
| 3,830,038 | 8/1974 | Propst | 53/190 |
| 3,889,727 | 6/1975 | Krul | 141/312 |
| 5,142,846 | 9/1992 | Alameda | 141/317 |
| 5,301,492 | 4/1994 | Kader | 53/459 |
| 5,413,157 | 5/1995 | McGregor | 141/314 |
| 5,535,792 | 7/1996 | McGregor | 141/316 |
| 5,771,667 | 6/1998 | McGregor et al. | 53/469 |

*Primary Examiner*—Steven O. Douglas
*Assistant Examiner*—Khoa Huynh
*Attorney, Agent, or Firm*—Collard & Roe, P.C.

[57] ABSTRACT

A filling device for filling bags, in particular with granular bulk material, in which there are provided a closeable filler neck (17) which is in connection with a reservoir and at least one pair of clamping arms (14) which are at least indirectly swivellable about a swivelling axle (2) for holding a bag (16) to be filled. In order to achieve a high degree of imperviousness between the bag to be filled (16) and the filler neck (17) it is provided that the filler neck (17) is made of an elastically deformable material and a pressing device (5, 9; 18, 19) is provided which acts on said filler neck and which presses the filler neck (17) flatly together in its pressing position, with two pairs of clamping arms (14) being provided which are arranged on either side of the pressing device (5, 9; 18, 19) or the filler neck (17) respectively, with the clearance of the pairs of clamping arms (14) exceeding the largest extension of the cross section of the filler neck (17) in its pressed state.

5 Claims, 6 Drawing Sheets

FILLING ARRANGEMENT

Figure 1:
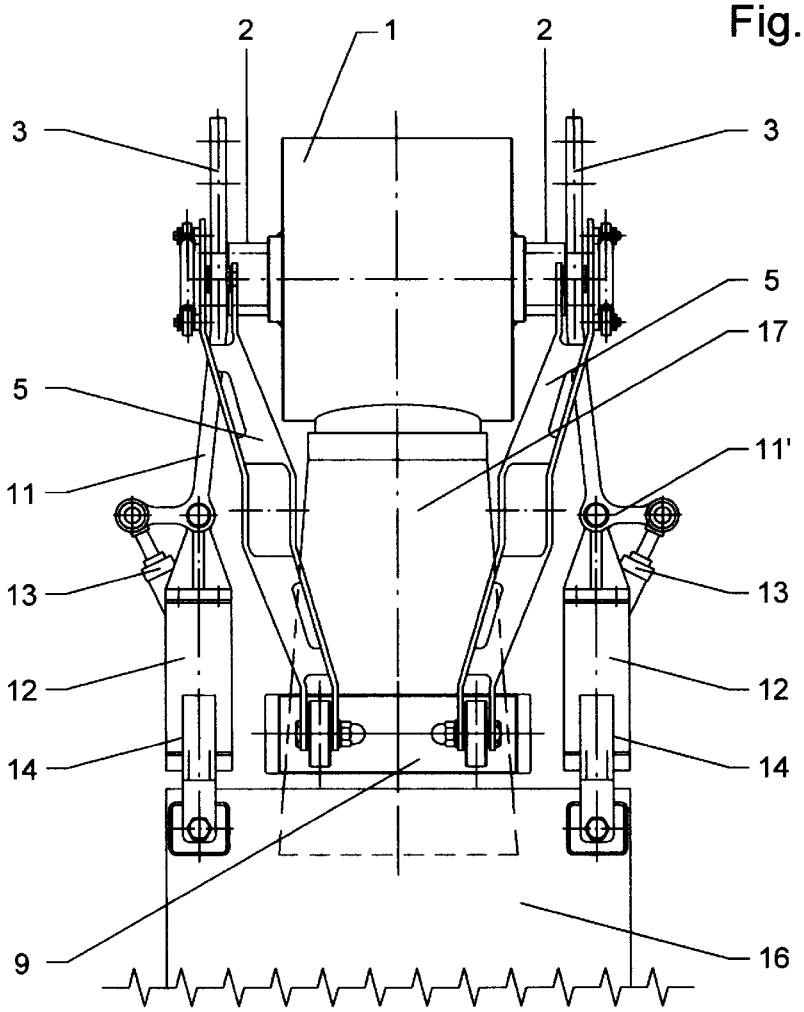

The invention relates to a filling device in accordance with the preamble of claim 1.

In known such filling devices, systems are employed in which multi-partite filler necks are used which are provided with parting gaps and commissures, and are arranged as conveyor chutes and guide plate elements. This enables the bag to be filled to be provided with a different cross-sectional shape during the slip-on than during the actual filling process.

This leads to the disadvantage, however, that a comprehensive sealing of the filling device against any escape of the filling material cannot be realized in a satisfactory manner due to the highly complex sequence of movements. Moreover, a highly unfavourable ratio of circumference to surface area is obtained by the usually rectangular cross section of the connection piece of the filling device to the bag, thus preventing an adequately fast filling of the bag with bulk materials with low flowing properties and of bags of a large length but with small opening cross sections.

Moreover, such filling devices are provided with a very complex structure, thus preventing a rapid and thus flexible adjustment of the filler neck. Moreover, such concepts usually require complex kinematic constructional designs in order to arrive from a position which is favourable for inserting the bag, which position is disposed between 0° and 45° downwardly inclined against the horizontal, to the vertical position optimal for the filling by a swivelling movement.

It is the object of the present invention to avoid such disadvantages and to provide a filling device of the kind mentioned above which is characterized by a simple arrangement and in which a substantial sealing of the bag to be filled is ensured with the filling device. Moreover, an adjustment of the filling device to bags with altered dimensions of their openings shall be enabled by the simple exchange of a few parts.

This is achieved in accordance with the invention in a filling device of the kind mentioned above by the characterizing features of claim 1.

The proposed measures allow easily producing an approximately circular or elliptical cross sectional shape which is optimal for the filling from a cross-sectional shape of low width which is longitudinally oriented for the insertion of the bag. Since the elastically deformable filler neck can be connected with the other mechanism of the filling device by way of a simple mechanical interface, a very simple exchange of the filler neck and thus also a simple adjustment to a changed geometry of the bag to be filled is possible.

The proposed measures further lead to the possibility of a very substantial sealing of the bag during the filling process, so that only a negligent burden to the environment is produced by dust even when very fine-grained materials are filled into the bag. Moreover, by using an elastically deformable material for the filler neck it is also ensured that the filler neck will open the bag which is inserted in substantially closed state and will adapt to its cross section. It is ensured by the fact that the bags are merely held at their two lateral border areas that the bags will open to a very high extent and the filling of the bag can occur very rapidly.

At the same time, a device for opening the bags can be omitted as are otherwise required in filling devices with substantially rigid filler necks. As a result of the adjustment of the cross section to that of the bag to be filled a very substantial sealing effect can be produced, thus substantially avoiding the problems with dust which usually occur otherwise when dusty materials are filled into bags.

The features of claim 2 lead to the advantage of a considerably facilitated drawing up of a bag onto the filler neck which is pressed together by means of pressing arms.

The swivelling mechanism which is connected with the elastic filler neck so as to form an integral unit represents a solution consisting of a very few functional elements in order to realize the change in position from a position which is downwardly inclined from the horizontal at an angle of 0° to 45° in which the bags are inserted on the filler neck to a position of the bag which is ideal for the filling process, preferably a vertical position of the bag.

The features of claim 3 lead to a solution with which the filler neck can be substantially compressed and can assume the function of a shut-off member which releases or interrupts the flow of the filling material to the bag to be filled. This is particularly possible where pourable fine-grained material is concerned.

The features of claim 4 lead to particular advantages in this respect.

The features of claim 5 lead to a very simple solution in a constructional respect.

Figure 2:
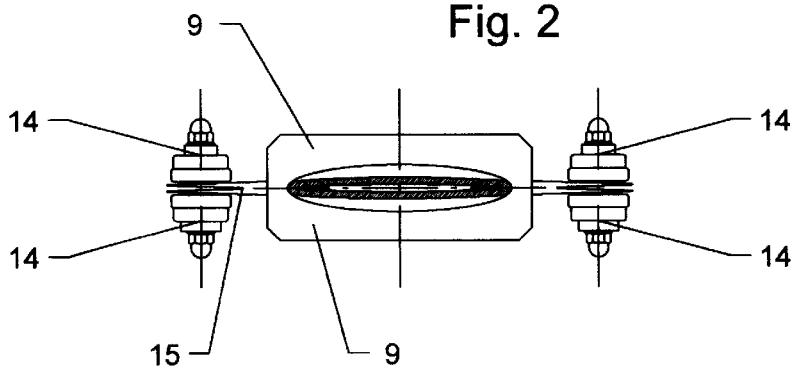
Figure 4:
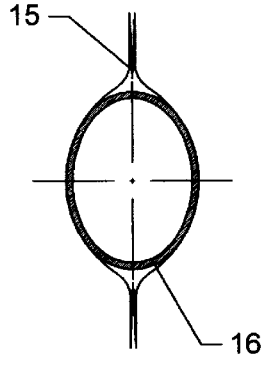
Figure 3:
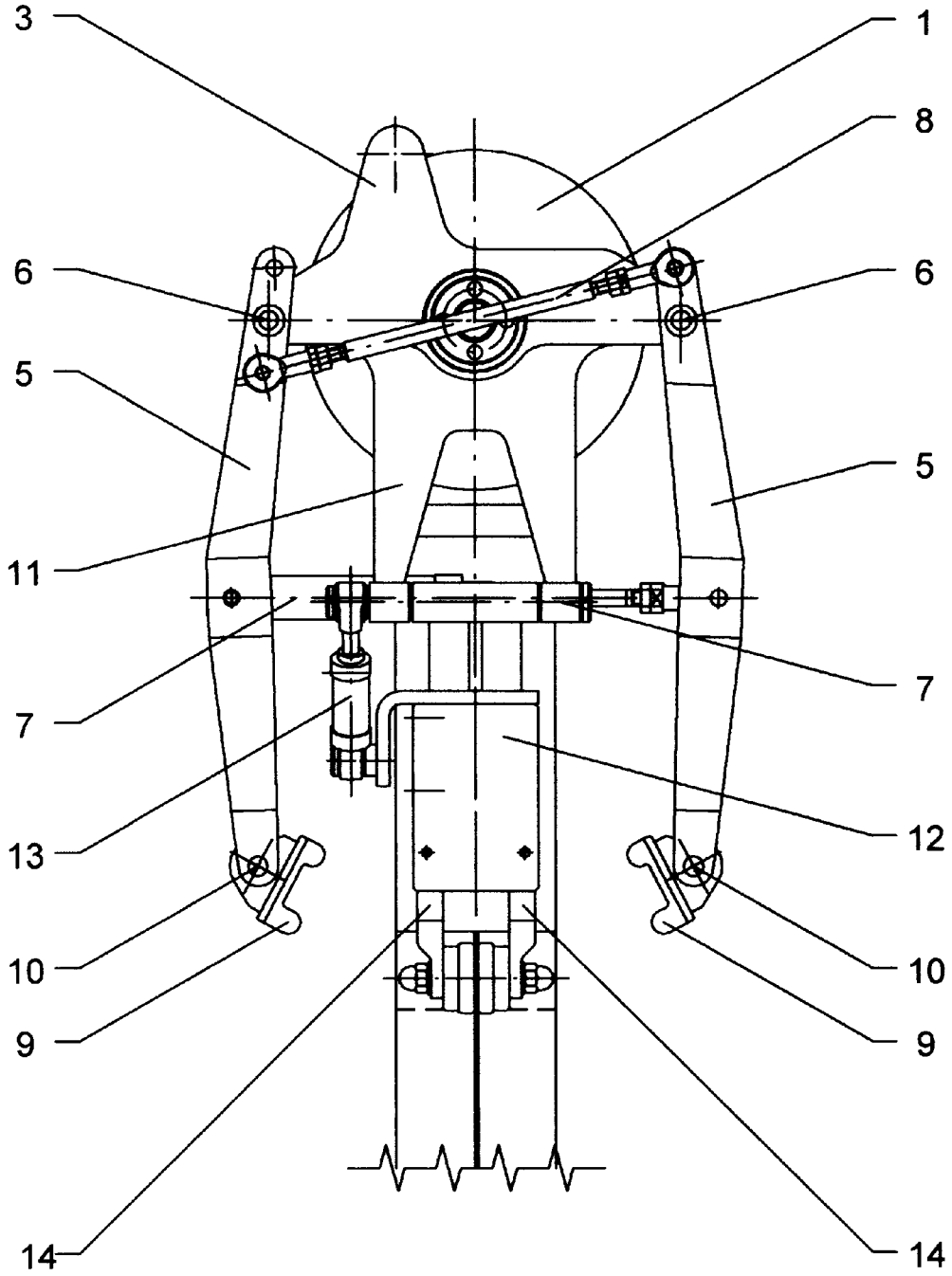
Figure 5:
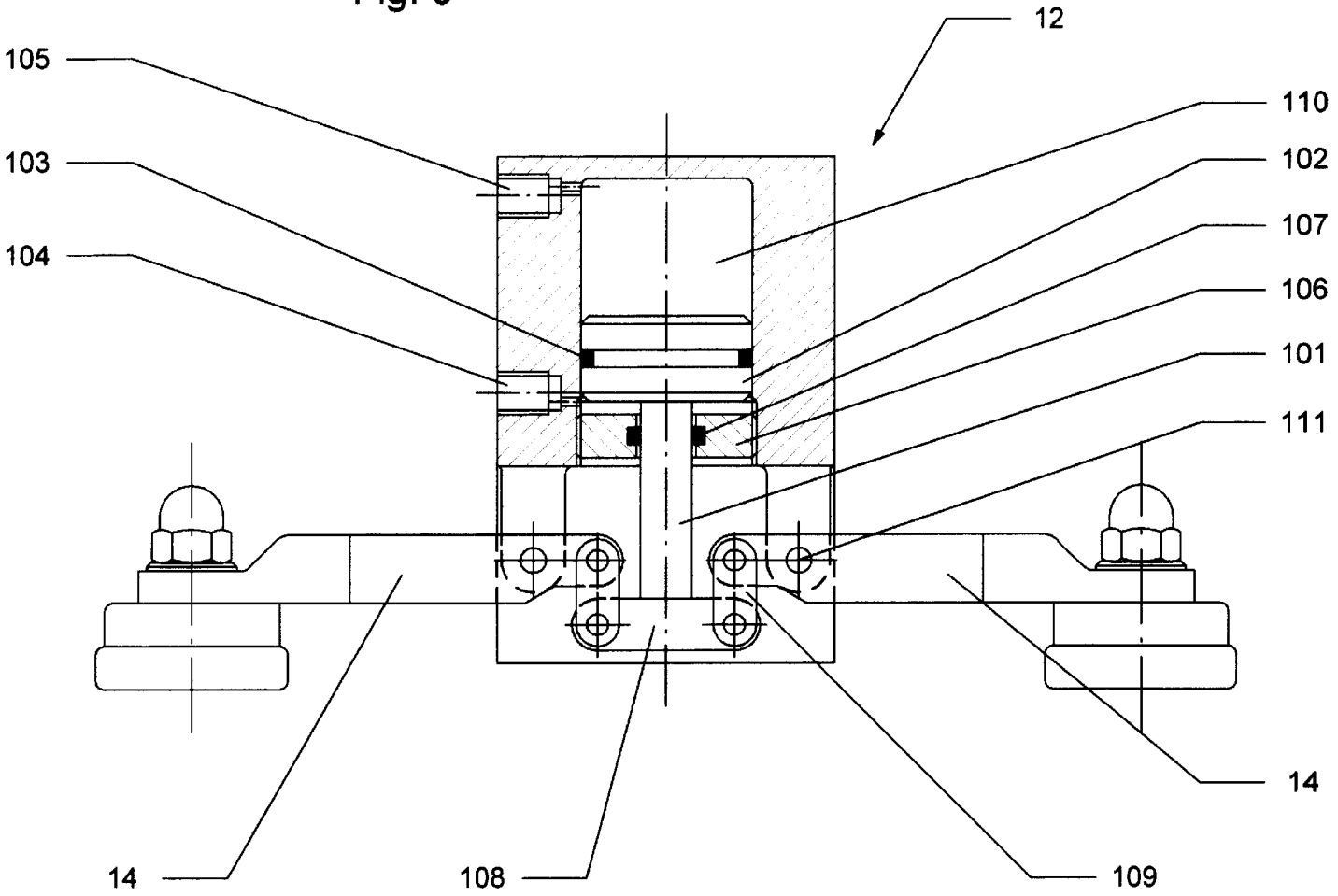
Figure 6:
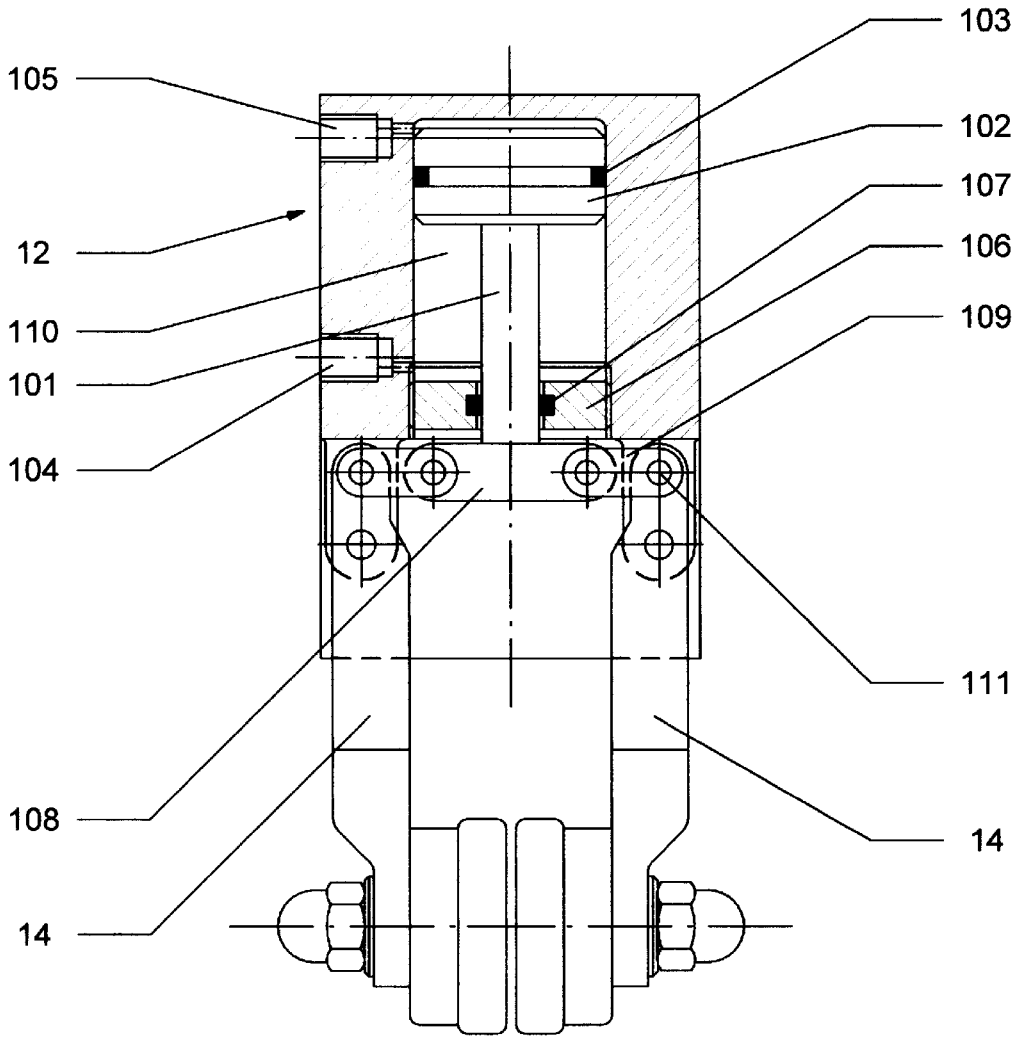
Figure 8:
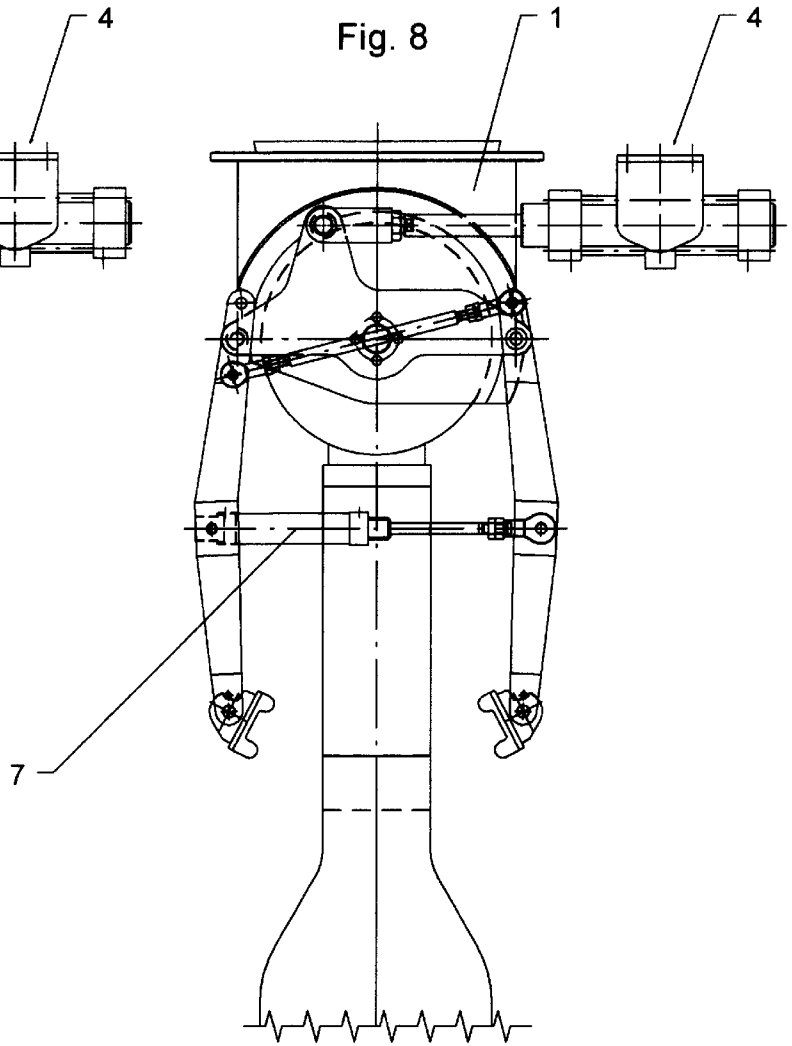
Figure 7:
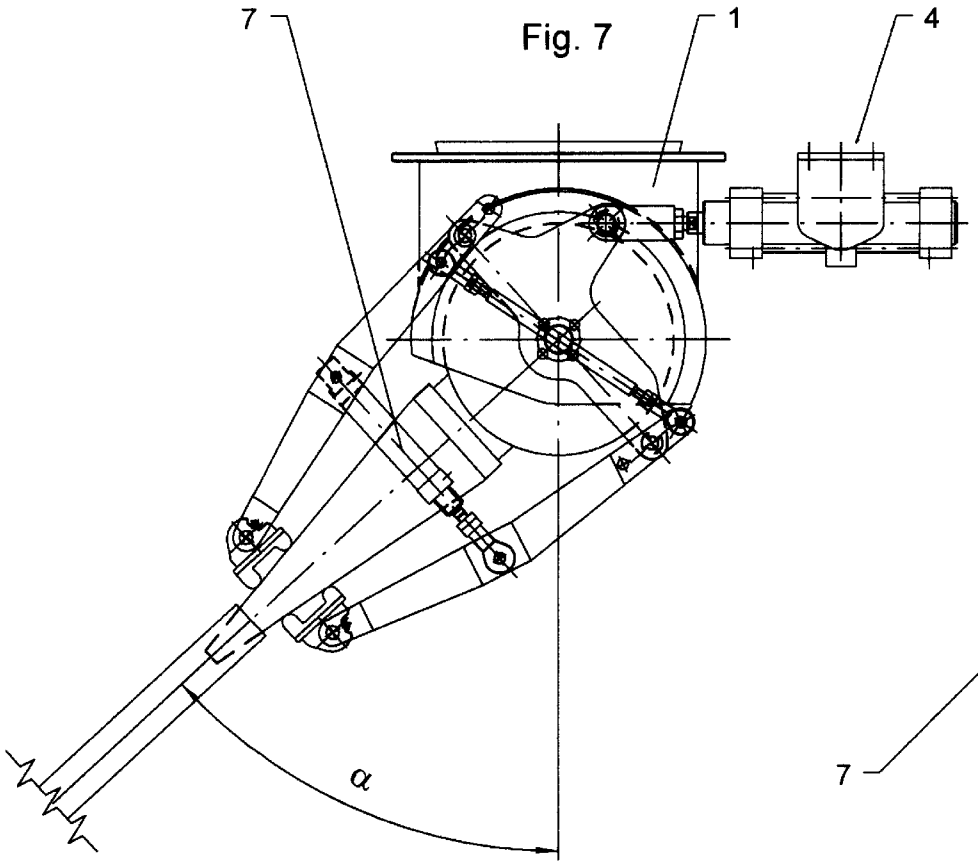
Figure 10:
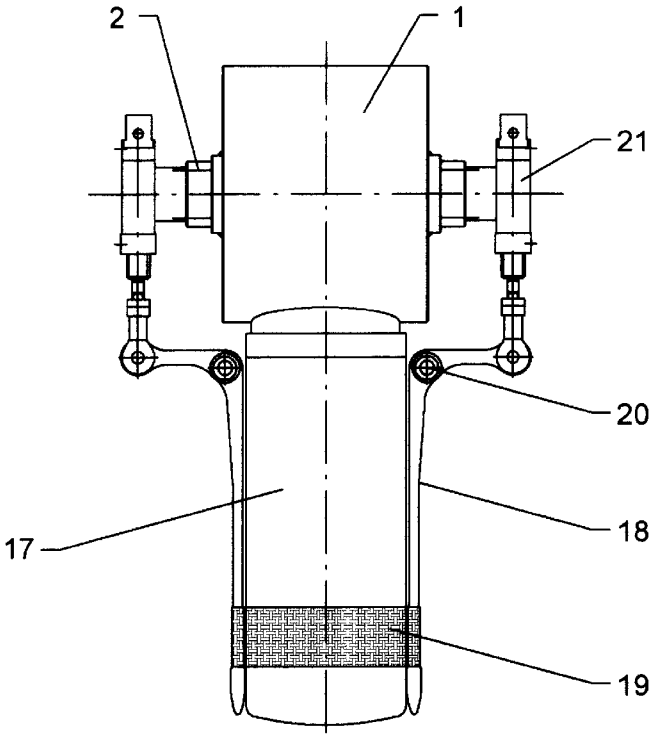
Figure 12:
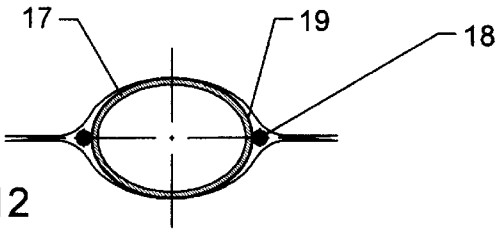
Figure 9:
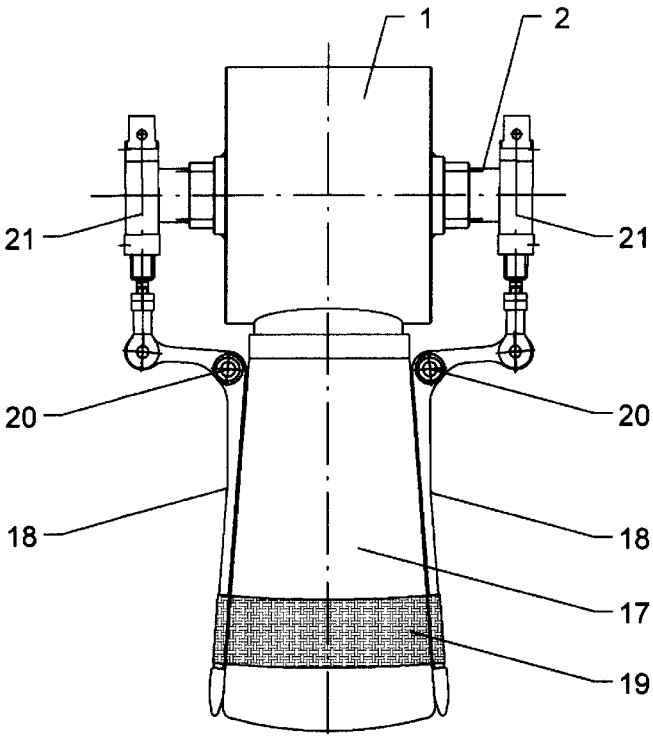
Figure 11:
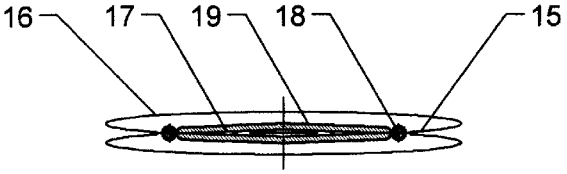

The invention is now explained in closer detail by reference to the enclosed drawing, wherein:

FIG. 1 schematically shows a view of a filling device in accordance with the invention;

FIG. 2 shows a simplified top view of the pressing and clamping arms of the filling device;

FIG. 3 schematically shows a side view of the filling device in the filling position with the inserted bag;

FIG. 4 schematically shows an inserted bag in a cross-sectional view;

FIG. 5 schematically shows a sectional view through a clamping device for clamping the side edges of a bag in the opened position;

FIG. 6 schematically shows a sectional view through a clamping device for clamping the side edges of a bag in the clamped position;

FIG. 7 schematically shows the filling device in the slip-on position for receiving a bag, with the clamping device for the holding devices of the side edges of the bag having been omitted;

FIG. 8 schematically shows a side view of the filling device during the filling, with the clamping devices for the holding devices of the side edges of the bags having been omitted;

FIG. 9 schematically shows a view of a further embodiment of a filling device in accordance with the invention in its closed condition, with the clamping devices for the holding devices of the side edges of the bags having been omitted;

FIG. 10 schematically shows a view of a further embodiment of a filling device in accordance with the invention in its filling condition, with the clamping devices for the holding devices of the side edges of the bags having been omitted;

FIG. 11 schematically shows a sectional view through a bag slipped on a filling device in accordance with FIG. 9, and FIG. 12 schematically shows a sectional view through a bag slipped on the filling device in accordance with FIGS. 9 and 10.

Axle stubs 2 project coaxially on either side from a hollow arranged carrier 1 whose interior is in connection with a reservoir (not shown). A holding device 3 is swivellably held on each of the same which, as can be seen from FIGS. 7 and 8, can be driven by way of a cylinder-piston arrangement 4.

One pressing device each is held on said holding devices 3, which pressing device is formed in the embodiments in accordance with FIGS. 1 to 8 by pairs of pressing arms 5 which are articulated on the holding devices 3 in a mutually diametrically opposite manner from one another and are swivellably held about axial stubs 6 extending parallel to the axles 2. The pressing arms 5 of each pair of pressing arms are swivellable against one another by means of a cylinder-piston arrangement 7 which connects the same at a distance from the axial stubs 6.

The pressing arms 5 of each pair of pressing arms 5 are further mutually connected by way of an adjusting rod 8 which is connected in an articulated manner above or below the axial stubs 6 with the pressing arms 5 of a pair each, is adjustable and fixable in its position and is used for setting the maximum path of movement of the pressing arms 5.

The pressing arms of the two pairs of pressing arms 5 which are disposed at either side of the axial stub 2 are mutually connected by way of pressing plates 9, with said pressing plates 9 being swivellably held about axles 10 extending parallel to the axles 2.

Extension arms 11 are further held on the holding devices 3 (which are only shown in FIGS. 1 and 3 for reasons of clarity of the illustration) on which a holding arm 12 each is held. A pair of clamping arms 14 is swivellably held in each of said holding arms 12, which clamping arms are swivellably about axles which are not shown in FIG. 1 and extend parallel to the axle stubs 2. The clamping arms 14 of each holding arm 12 are swivellable in mutually opposite directions with respect to the arms of each pair of clamping arms 14 by means of cylinder-piston arrangements contained in the holding arms 12, as will be explained below in closer detail by reference to FIGS. 5 and 6. The clamping arms 14 are used for holding or clamping the side edges or folds 15 of bags 16 in order to also allow the holding of a bag 16 during the filling. The free end zones of the clamping arms 14 are provided with a greater distance from the axle stubs 2 than the pressing plates 9 of pressing arms 5.

The holding arms 12 are swivellably held on the extension arms 11 and outwardly pretensioned by means of a spring 13 each which is articulated on an outwardly projecting shoulder 11' of the extension arms 11. This allows the holding arms 12 or the clamping arms 14 respectively to slightly move in the direction of the pressing plates 9.

The clamping devices for holding the bags which are formed by the clamping arms 14 and the holding arms 12 are appropriately arranged as are shown in FIGS. 5 and 6. A cylinder bore 110 is arranged in the interior of each holding arm 12, in which bore a piston 12 provided with a packing 103 is held in a displaceable manner, with the piston 102 or its piston rod 101, respectively, penetrating a sealed lid 106 which is screwed into the holding arm 12. The piston rod 101 is sealed by means of a packing 107 inserted into the lid 106. The piston rod 101 is connected at its free end with a carrier 108 which stands perpendicular to the same and at whose two ends connecting rods 109 are articulated which further are articulated on the clamping arms 14 which are arranged as two-arm levers, with the swivelling axles 11 of the clamping arms 14 extending parallel to the axle stubs 2. The carrier 108 forms toggle joints with the connecting rods 109 and the clamping arms, with the clamping arms being situated in an over-dead-centre position in their clamping position (FIG. 6) from which they can only be brought by the cylinder-piston arrangement 13, but not by forces acting upon the free ends of the clamping arms.

Connections 104, 105 are provided for pressurizing the piston 102 with a pressure medium, e.g. pressure oil, which connections are provided with cross bores opening into the cylinder bore 110.

A filler neck 17 is held on the lower side of carrier 1, which filler neck is made of an elastically deformable material and is provided in the relaxed state with a substantially circular or elliptical cross section. Said filler neck 17 projects up until below the lower edge of pressing plates 9.

For the purpose of filling, a bag 16 is slipped on to the filler neck 17, which is pressed together by means of the pressing arms 5 or pressing plates 9, in the position (as shown in FIG. 7) which is swivelled away from the vertical by an angle which is preferably 45° and is held by means of the clamping arms 14 (not shown in FIG. 7). Thereafter the holding devices 3 are swivelled back to the vertical position of the pressing arms 5 by means of the piston-cylinder arrangement 4 and thereafter brought to their opened position by means of the cylinder-piston arrangement 7 (FIG. 8), with the clamping arms remaining in their clamped position, however. As a result, the filler neck 17 returns to its relaxed position and assumes the cross-sectional shape with the bag 16 as is shown in FIG. 4, whereupon simultaneously the flow of the material to be filled is released through the filler neck 17. During the opening of the filler neck the side edges of the bag 16 approach one another, with also the clamping arms 14 which are located in the clamping position, or the holding arms 12 which hold the same, approaching one another against the force of springs 13.

As is shown in FIG. 4, the inner wall of bag 16 rests very closely on the outer side of the filler neck 17, with only very small cross sections remaining between said walls. Accordingly, there will be very little dust development during the filling of the bag, even when very fine-grained material is used.

After the filling of the bag which is appropriately supported by a liftable or lowerable platform (not shown) the pairs of clamping arms 14 are opened by actuation of the cylinder-piston arrangements 107, 110 in the holding arms 12 and the bag 16 can be withdrawn from the filler neck 17, with the flow of the material through the filler neck being interrupted, which can be performed by compressing the same or by closing a shut-off member provided upstream of the filler neck 17.

Following the compression of the filler neck and the swivelling of the holding devices 3 it is possible to slip on a new bag and the described cycle is repeated.

The pressing device is formed in the embodiment in accordance with FIGS. 9 to 12 by a pair of expansion arms 18 and an elastic band 19 which is attached thereto and is wrapped around the filler neck 17 in its zone close to its free end. The extension arms 18 are arranged as bell-crank levers which are swivellable about axles 20 which extend perpendicular to the axle stubs 2 and are connected in a manner not shown herein with the swivellable holding devices 3 which are also not shown in FIGS. 9 to 12.

The holding arms 12 and clamping arms 14 which are also needed in this embodiment are not shown in the FIGS. 9 to 12 for the purpose of better clarity of the illustration.

Once the extension arms 18 are brought into the expanded position as shown in FIG. 9 by means of the cylinder-piston arrangements 21 which are swivellably held jointly with the holding devices 3 and the hollow carrier 1 (not shown), the elastic band 19 is tensioned and presses the filler neck 17 together which is made of an elastically deformable material, as is shown in FIG. 11.

In this state a bag 16 can be slipped on, with the bag being held in the zone of its side folds 15 by the clamping arms 14 (not shown). When thereafter the carrier 1 including the filler neck and the extension arms 18 is swivelled back to the vertical position and the extension arms 18 are brought to the idle position as shown in FIG. 10 in which they are pretensioned by the elastic band 19, the elastic band 19 is relaxed and the elastic restoring force of the filler neck 17 is adequate so that the same can return to its relaxed position as is shown in FIG. 12.

The filling of the bag 16 can occur in this process as has already been explained in connection with FIGS. 1 through 8.

What is claimed is:

1. A filling device for filling bags, in particular with granular bulk material, in which there are provided a closeable filler neck (17) which is in connection with a reservoir and two pairs of clamping arms (14) which are at least indirectly swivellable about a swivelling axle for holding a bag (16) to be filled, characterized in that the filler neck (17) is made of an elastically deformable material and a pressing device (5, 9; 18, 19) is provided which acts on said filler neck and which presses the filler neck (17) flatly together in its pressing position, with said two pairs of clamping arms (14) being provided which are arranged on either side of the pressing device (5, 9; 18, 19) or the filler neck (17) respectively, with the clearance of the pairs of clamping arms (14) exceeding the largest extension of the cross section of the filler neck (17) in its pressed state.

2. A filling device as claimed in claim 1, characterized in that the filler neck (17) is swivellable together with the pressing device (5 9; 18, 19) and the clamping arms (14) about the swivelling axle (2), on which the clamping arms (14) are held at least indirectly.

3. A filling device as claimed in claim 1, characterized in that the pressing device (5, 9; 18, 19) is formed by pairs of pressing arms (5) which can be moved against one another.

4. A filling device as claimed in claim 3, characterized in that pressing arms (5) which are parts of different pairs of pressing arms are mutually connected through a pressing plate (9) which is preferably connected in an articulated manner with the pressing arms (5).

5. A filling device as claimed in claim 1, characterized in that the pressing device is formed by a pair of extension arms (18) and an elastic band (19) wrapped around the filler neck (17), which band is connected with the extension arms (18).

* * * * *